US005170861A

United States Patent [19]

Turner

[11] Patent Number: 5,170,861

[45] Date of Patent: Dec. 15, 1992

[54] FOLDING TRIPLY-BRACED SAWHORSE BRACKET

[76] Inventor: William D. Turner, 741 Center Dr., Memphis, Tenn. 38112

[21] Appl. No.: 736,007

[22] Filed: Jul. 25, 1991

[51] Int. Cl.[5] ..... B27B 21/00; B27H 1/06

[52] U.S. Cl. ..... 182/153; 182/225

[58] Field of Search ..... 182/153, 155, 181-186, 182/224, 225

[56] References Cited

U.S. PATENT DOCUMENTS

| | | | |
|---|---|---|---|
| 1,159,299 | 11/1915 | Van Huzer | 182/153 |
| 2,324,196 | 7/1943 | Crozier | 182/186 |
| 2,573,740 | 11/1951 | Spikings | 182/155 |
| 2,666,673 | 1/1954 | Hughes | 182/225 |
| 2,825,606 | 3/1958 | Rebensdorf | 182/153 |
| 2,829,012 | 4/1958 | Snyder | 182/225 |
| 4,245,718 | 1/1981 | Poston et al. | 182/153 |
| 4,325,463 | 4/1982 | Taylor | 182/155 |
| 4,926,966 | 5/1980 | Boudreau | 182/155 |

*Primary Examiner*—Reinaldo P. Machado

*Attorney, Agent, or Firm*—Walker, McKenzie & Walker

[57] ABSTRACT

A quickly foldable and substantially braced sawhorse bracket, to which, in conjunction with a second, like, sawhorse bracket, are attached an elongated top beam 34 and four elongated leg members 36 to create a single, foldable sawhorse; utilizing a flat top beam attachment plate 14 and L-shaped leg attachment angle plates 22 for variety in cross-sectional dimensions of top beam 34 and leg members 36; two almost identical bracket sides 46 of bracket being pivotally joined at two points on top and hingedly joined and braced by a pivotally operating spreader brace 24 attached to lower leg plates 22. Utilization of above sawhorse in pairs as supports of considerable loads supported on top beams 34, with extreme stableness achieved by web braces 16; with a lower level of support for lighter loads being possible by position of spreader braces 24; and further additional utilization of a resultant vertical, all wood surface of leg pairs as a support and clamping station for wood doors and wood boards for work on the edges thereof.

12 Claims, 4 Drawing Sheets

FIG. 3
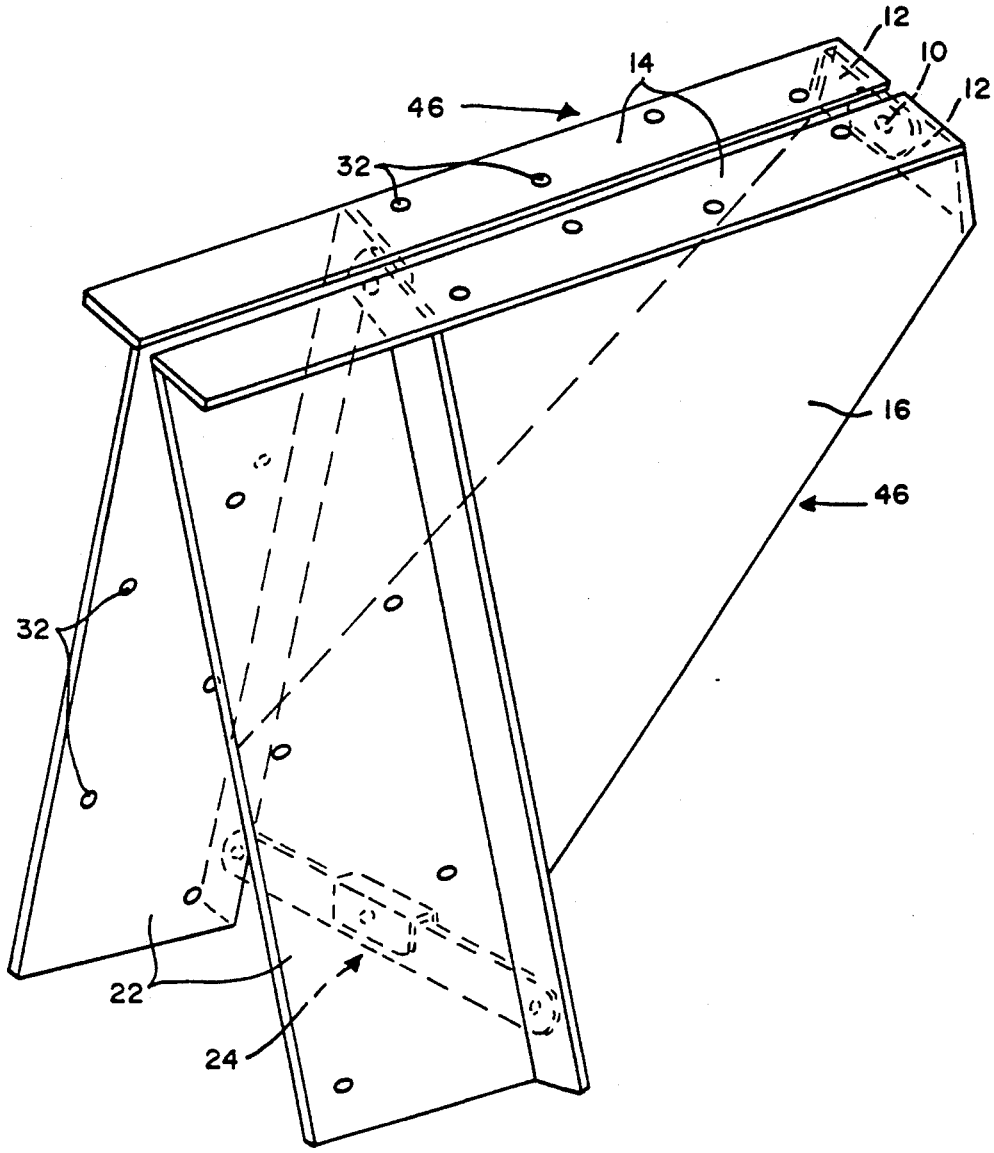
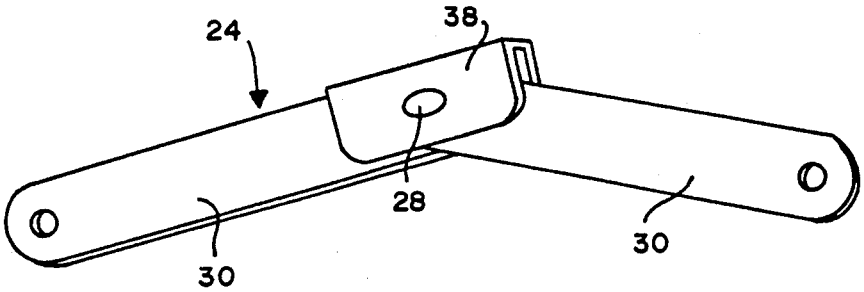
FIG. 4

FOLDING TRIPLY-BRACED SAWHORSE BRACKET

BACKGROUND

1. Field of Invention

This invention pertains to brackets to which wood members are attached for the creation of a sawhorse. It is a folding, very substantially braced bracket designed, primarily, for the commercial user.

2. Cross Reference to Related Applications

This sawhorse bracket is designed such that it maintains wooden leg members in a vertical inclination at the end of the sawhorse, with a top wooden beam even with the outside surface of the wooden leg members, not overlapping. This vertical, all wood surface with no hardware obstructions, allows for the supporting and clamping of work pieces, specifically, wooden doors, to this surface without marring. The wooden door can be clamped in such a position that one edge stands about 1" to 3" above the top of the sawhorse for purposes of unencumbered planing, hinge mortise routing, and belt sanding.

The supporting and clamping referred to can be done with combinations and modifications of conventional clamps attached at appropriate heights on two sawhorse legs. However, it can be done more easily and readily by the use of a new "door support clamp", a patent application for which is to be forthcoming shortly from this same applicant.

3. Description of Prior Art

Heretofore, complete sawhorses and sawhorse brackets have been offered, some with no folding capabilities but many with folding capabilities to different degrees. Some are not braced at all, some are minimally braced, and some are more substantially braced but, often, with a reduction in the ease of foldability. All offer a completed sawhorse with both legs of both pairs of legs splayed apart from each other at their bottom ends, a necessary requirement. In the other plane, viewing the sawhorse from the side, the pairs of legs are often inclined inwardly, although some are set completely vertically. The top member often times overlaps beyond the outside surface of each pair of legs, although in some cases it does not. Even in this last case, however, whereby a vertical surface with a non-overlapping top exists, this outer, vertical surface is not a wholly uninterrupted, smooth wooden surface. This is due to the design of the metal attachment plates employed, usually u-shaped or rectangular tubing, as well as external metal spreader braces, screw, nail or bolt heads, and other metal elements. These conditions of non-verticality, and also, of verticality but with metallic obstructions lend themselves adversely to one of the primary uses of the sawhorses constructed from this new bracket, discussed more fully further down.

As a general comment on the versatility of brackets as compared to complete sawhorses, brackets offer a user more latitude in the resultant height and length of the finished sawhorse, in that most allow for attachment of wooden leg and top members of various lengths, at least within a certain range. However, the brackets, even, are limiting as to the cross-sectional dimensions of the wood members used, due to the aforementioned usage of u-shaped and rectangular metal attachment plates. Also, some of the sawhorse brackets currently available require assembly and disassembly of the wood top and leg members each time they are used, an inconvenient situation.

OBJECTS AND ADVANTAGES

Accordingly, this new sawhorse bracket has been conceived to overcome some of the limitations of the prior art, to combine all of the desirable elements, to offer a choice in the cross-sectional dimensions of the wood members, and to offer a new usage.

The objects of this new invention are to offer, primarily, to commercial users, a bracket whereby they can attach wood members of varying lengths and cross-sectional dimensions to construct sawhorses of a particular height, length and weight to suit their particular enterprises. It, also, allows for overlap or non-overlap of the top beam, as desired.

It is an object of this bracket to provide foldability for the obvious storage and transport advantages, but in such a way that each sawhorse can be set up or folded up as rapidly as a stepladder can. Further, it is an object to minimize the wobbliness found in some of the prior art folding brackets by employing a permanent web brace between a leg attachment plate and a top beam attachment plate, in addition to a spreader brace between a pair of leg plates which is located at a point far enough down on the leg plates to securely brace this juncture. The design of this bracket, as far as strength is concerned, anticipates some usages whereby substantial loads of wood framing lumber are stored for periods of time during construction.

Also, it is an object of this bracket's design to provide sawhorses with a vertical, wood surface across the ends of either pair of legs unobstructed by metal hardware, against which wooden doors, but also wood boards, can be supported and clamped with the edge of the door or board about 1 to 3 inches above the top of the top beam of the sawhorse. The purpose of this is so that one carpenter alone, can position and secure a door or board, without fear of marring the surface of the door or board, and then plane the edge, rout the edge for hinge mortises, or belt sand the edge with no encumbrances. This supporting and clamping of the work piece against the sawhorse legs can be achieved with modifications and combinations of existing clamps being applied to the sawhorse legs. But it can also be done by a newly invented clamp, designed specifically for this purpose, described in a separate patent application to be submitted soon after this patent application. One other advantage of this design, is that a board, such as a $2\times6$, can be laid across the internally located spreader braces, without projecting beyond the outside surface of the legs, to provide a lower storage level for boards, etc.

Consequently, this bracket, by means of an uncomplicated design, featuring some combinations and modifications of existing elements of the prior art, maximizes the advantages and minimizes or eliminates some of the disadvantages, plus offering a new usage.

Further objects and advantages of this invention will become apparent from a consideration of the drawings and ensuing description of it.

DRAWING FIGURES

FIG. 3 is a perspective view of one bracket.

FIG. 4 is an enlarged view of the preferred embodiment of a spreader brace.

REFERENCE NUMERALS IN DRAWINGS

Figure 1:
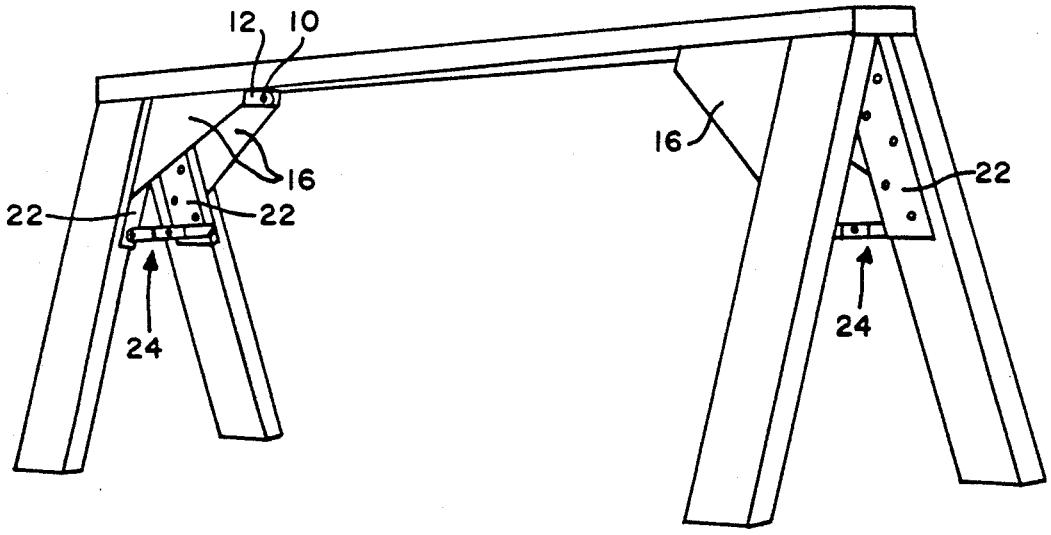
FIG. 1 is a perspective view of a sawhorse set up using two of the sawhorse brackets.

10: inner pivot
12: inner pivot tabs
14: top beam attachment plate
16: web brace
18: upper leg pivot
20: upper leg pivot tabs
22: leg attachment angle plate
24: spreader brace
26: outer spreader brace pivots
28: center spreader brace pivot
30: spreader brace plates
32: screw attachment holes
34: top beam
36: leg
38: center spreader brace stop sleeve
40: pivot bolt
42: lock nut
44: threaded stud
46: bracket side

DESCRIPTION

FIGS. 1 to 5

Figure 2:
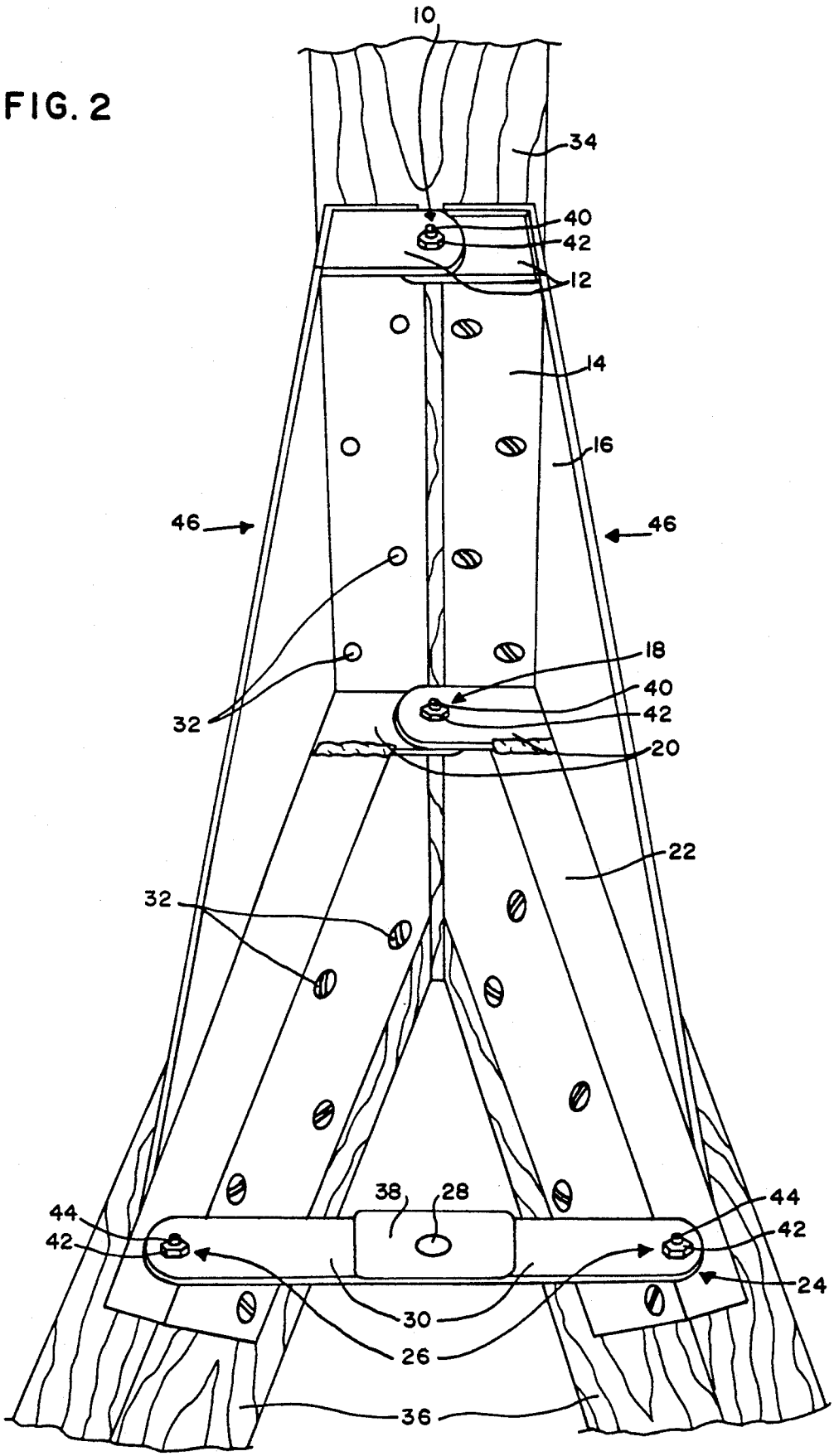
FIG. 2 is a 45° bottom view of one sawhorse bracket, with sawhorse legs and top beam attached.

In general, this sawhorse bracket, as seen in FIG. 2 and FIG. 3, is composed of two bracket sides 46, each side being almost identical to the other. Each side 46 consists of three main parts each, a top beam attachment plate 14, a leg attachment angle plate 22, and a web brace 16. This web brace joins both above mentioned plates in such a manner as to be a substantial brace between the two. Both sides 46 of the sawhorse bracket are pivotly joined together at two upper pivoting areas. At one area an inner pivot 10 is located on two inner pivot tabs 12, on each per bracket side 46; at the other area, an upper leg pivot 18 is located on two upper leg pivot tabs 20, one each per bracket side. Both two sides 46 are further hingedly joined together by a spreader brace 24. This spreader brace 24, itself, consists of two flat, elongated plates hingedly connected by a center spreader brace pivot 28, all within a stop sleeve. This spreader brace 24 is hingedly connected to the lower end of each sides' leg attachment angle plate 22 at an outer spreader brace pivot 26 on each leg plate.

More specifically, the preferred embodiment of this sawhorse bracket is as follows:

As a general statement, the dimensions of the various elements mentioned in this description anticipates general usage of a size lumber referred to as "2×4'"s, 38.1 mm×88.9 mm (1½"×3½"), for a top beam 34 and legs 36. However, the preferred dimensions of the elements allow for usage of lumber of lesser, to a degree, and greater cross-sectional dimension.

Both top beam attachment plates are 41.28 mm×254.0 mm (1⅝"×10"). Both leg attachment angle plates 22 are 304.8 mm (12") long, formed of L-shaped metal, consequently, with two flanges, one 69.9 mm (2¾") wide, and the other 25.4 mm (1") wide. The narrower flange of leg plate 22 is cut at an angle of 65° at the upper end. Each web brace 16 is shaped triangularly, but with the upper, inner point removed, and is, consequently, four-sided. The dimension along the upper edge is 177.8 mm (7"); the dimension along the long side edge is 177.8 mm (7"); the dimension along the short side edge is 25.4 mm (1"); the dimension along the diagonal edge is 234.95 mm (9¼").

Leg plate 22 is attached to the underside of top plate 14 such that the top edge of the wide flange of leg plate lies along one edge of top plate 14, with the top, outside corner of the wide flange even with the end corner of top plate 14, and the 65° angled top edge of the narrow flange of leg plate 22 engages the underside of top plate 14 across its width. These two junctures are welded.

Web brace 16 lies alongside the leg plate 22/top plate 14 combination such that the long side edge of web brace 16 aligns with the outer edge of the narrow flange of leg plate 22 with the top corner of the long side of web brace 16 being even with the outside corner of the narrow flange of leg plate 22. The top edge of web brace 16 aligns with one edge of top plate 14, with the top edge/short edge upper corner of web brace 16 being even with the end of top plate 14. This juncture is welded.

The above two paragraphs describe the combination of the main three pieces of one bracket side 46 of this invention. The opposite is manufactured exactly the same except it is done as a mirror image of the first side.

For the pivotal joining together of the two sides 46, four tabs are attached at two points per side 46. Each tab is 25.4 mm×63.5 mm (1"×2½") with one end shaped at a 65° angle and the other end with both corners, or at least the upper corner, diagonally opposite the 65° angle of the other end, rounded on a 7.9 mm (½") radius. A pivot hole 7.9 mm (5/16") in diameter is located 12.7 mm (½") from the radiused end and 12.7 mm (½") from each side. The tabs are located thusly: an inner pivot tab 10 lies such that its angled end lies alongside the short edge of web brace 16 and its top edge alongside the end of the top plate 14. These junctures are welded. An upper leg pivot tab 20 lies such that its angled end lies alongside the juncture made by web brace 16 and the outer edge of the narrow flange of leg plate 22, and its top edge lies alongside the juncture made by the 65° angled top edge of the narrow flange of leg plate 22 and the underside of top plate 14. These junctures are welded.

An inner pivot tab 12 and an upper leg pivot tab 20 are assembled to the opposite sawhorse bracket side 46 at the corresponding positions, except that they are located at a distance inward from their mate tabs equal to the thickness of the mate tabs so that the mating tabs will bypass each other.

The inner pivot tabs 12 are connected by inner pivot 10, comprised of a pivot bolt 40, 7.9 mm×15.88 mm (5/16"×⅝") and a lock nut 42, 7.9 mm (5/16"). The upper leg pivot tabs 20 are connected, likewise, by upper leg pivot 18, comprised of pivot bolt 40 and lock nut 42.

The lower ends of leg plates 22 are hingedly joined together by spreader brace 24, seen in FIG. 4, which is comprised of two spreader brace plates 30, one center spreader brace stop sleeve 38, one center spreader brace pivot 28, and two outer spreader brace pivots 26. Each plate 30 is 25.4 mm×184.2 mm (1"×7¼") and both ends are rounded. There are two holes 7.9 mm (5/16") in each brace 30, both centered in the width of brace 30, one end hole centered 12.7 mm (½") from one end, and one center hole being 136.5 mm (5⅜") from the end hole.

The stop sleeve is 82.55 mm ($3\frac{1}{4}''$) long and is three-sided, with two wider flanges 27 mm (1 1/16") wide connected by a center flange 9.5 mm ($\frac{3}{8}''$) wide, with a space between the two wider flanges being about 6.4 mm ($\frac{1}{4}''$). Stop sleeve 38 has a hole 7.9 mm (5/16") in diameter in the center of each side flange. Stop sleeve 38 is affixed over the center end of one brace plate 30 by spot welds, with their holes aligning. The other brace plate 30 is pivotally connected to the first within the stop sleeve by a rivet. The end holes of spreader brace 24 are pivotally connected to the narrow flange of leg plates 22 by a threaded stud 44 (7.9 mm×12.7 mm ($5/16''\times\frac{1}{2}''$) and a lock nut 42. One stud 44 each is located near the center line of the narrow flange of each leg plate 22, at a position such that when the entire folding sawhorse bracket is fully opened the spreader brace 24 is fully elongated.

For the attachment of wood legs 36 and wood top beam 34, there are holes 32 placed in a staggered manner along both the wide flange of leg plate 22 and top plate 14.

In the preferred embodiment of this invention top plate 14, leg plate 22, and web brace 16 are constructed from 14 gauge sheet steel; the pivot tabs 12 and 20, and spreader brace plates 30 are constructed from 11 gauge sheet steel. Where welds at angles between parts are mentioned, sheet metal patterned and bent to yield the same resultant configurations would be equally suitable.

OPERATION

FIGS. 1, 4, 5

Regarding the usage and operation of this invention, a user would need two sawhorse brackets to construct one sawhorse, and four brackets to construct a pair of sawhorses, a pair of sawhorses being the most standard situation.

The brackets are designed with threaded pivot bolts 40 and threaded studs 44 used with lock nuts 42, instead of using rivets, so the two sides 46 of the bracket can be separated for ease of application of wood legs 36 and top beam 34, neither of which are part of the invention.

A user would apply wood legs, normally, but not necessarily 2×4's, cut at an angle of 65° at each end, and of a length which would yield a sawhorse of a height suitable to himself. With the two sides 46 of the bracket separated, one wood leg each would be inserted into the leg plate 22 with the wide side of the wood leg against the wide flange of leg plate 22 and the narrow side of the wood leg against the narrow flange of leg plate 22, and with the 65° angled upper end of the wood leg touching the underneath surface of top plate 14. The wood leg would be attached through holes 32 on leg plate 22 by round head or pan head screws preferably about 6.4 mm×31.75 mm ($\frac{1}{4}''\times1\frac{1}{4}''$). The wood legs having been installed on each side 46 of the sawhorse bracket, the two sides would be reassembled.

A top beam would now be attached by placing on a flat surface a wood top beam, normally, but not necessarily a 2×4, cut to the desired length of the finished sawhorse. One assembled sawhorse bracket, with wood legs attached, would be turned upside down on the top beam, the center line of the bracket aligned with the center line of the top beam. Depending on whether the user desires a finished sawhorse with the end of the top beam even with the outside of the pair of wood legs or with the top beam overlapping the legs, he would position the sawhorse bracket accordingly. The sawhorse bracket would then be attached with screws through the holes 32 in one of the top plate 14 members only. To attach through the other top plate 14 member would make the folding of the sawhorse bracket impossible.

The second sawhorse bracket would then be attached at the other end of the top beam, either in the even or overlapping position. Three combinations of even or overlapping top beam can be achieved on any one sawhorse, either even/even, overlapping/overlapping, or even/overlapping, yielding different combinations of utility. The second bracket would necessarily have to be attached through the top plate 14 member lying along the same side of the top beam as the top plate 14 member used for attachment on the front bracket. This, of course, is to not negate the folding ability of the sawhorse. After these operations a user has a completed sawhorse.

To employ one or more folding sawhorses, a user has only to spread each pair of legs apart by means of spreader brace 24, pushing spreader brace 24 downward until it is in an elongated, horizontal position, the center spreader brace stop sleeve 38 not allowing the spreader brace 24 to fold downward below the horizontal. This setting up operation takes less than 5 seconds. To fold up the sawhorse, a user performs the reverse operation, which likewise takes less than 5 seconds. This is as fast or faster than any other folding sawhorses.

In the folded up position, the legs of each pair lie alongside and parallel to each other, yielding a flat sawhorse. Consequently, about 10 of these sawhorses can be stored or transported in a space normally occupied by about 2 non-folding sawhorses. Also, a user can transport 2 to 6 folded sawhorses in a vehicle such as a pickup truck with a net savings on space compared to the transport of even just 2 non-folding sawhorses. This saved space is most often needed for transport of material.

Besides the normal usage of sawhorses, usually in pairs, as a support of lumber and as a work station, an additional usage of sawhorses constructed with these sawhorse brackets is described below.

Figure 5:
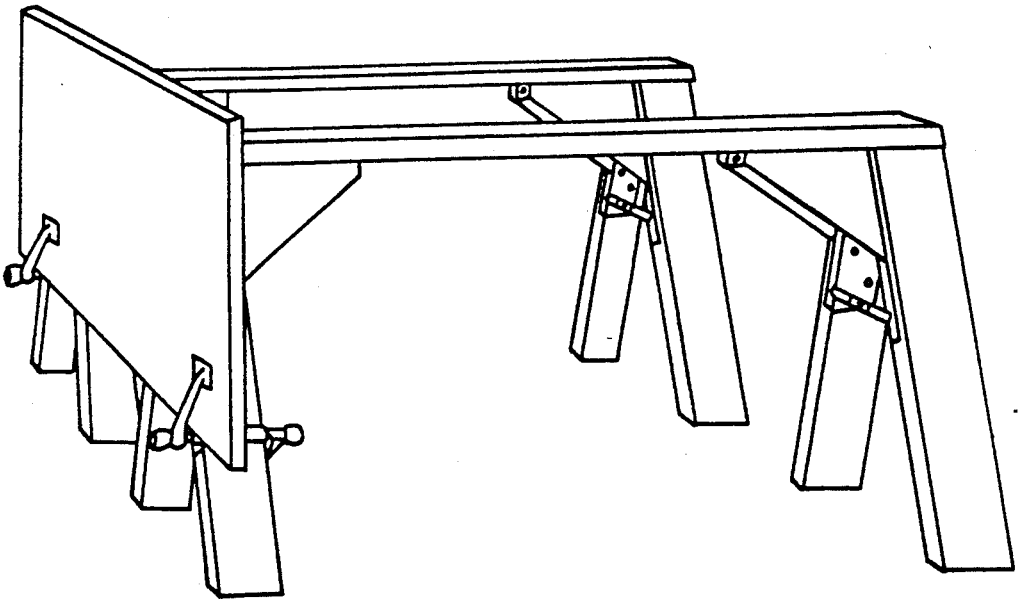
FIG. 5 is a perspective view of two sawhorses set up in conventional fashion, with a wooden door supported and clamped against the end of the outside surfaces of one pair of legs on both sawhorses, using a special door clamp.

If the sawhorses are assembled in the even position, that is, with the end of the top beam even with the outside surface of the legs, a completely vertical, all wood surface is achieved. This surface is an ideal surface against which a wooden door can be clamped, as seen in FIG. 5. This is achieved when two such sawhorses are positioned in the normal positioning of a pair of sawhorses, with the top beams of each sawhorse being about 4 feet to 6 feet apart. Two special door support clamps, the description of which is described on a soon forthcoming patent application, are clamped to one leg of each pair of legs of each sawhorse. The clamps are positioned on the sawhorse legs at such a height that the edge of the door is elevated 1" to 3" above the top of the top beam. The two clamps are also positioned to be less far apart than the length of the door. A wooden door, or board, can now be clamped against the all wooden surface of the sawhorse legs without marring, and in a position for the edge to be planed, routed or sanded, unobstructed, over its entire length, with no assistance from a second person.

This door clamping usage of sawhorses assembled with these brackets does not require, necessarily, the door support clamp mentioned above. It can be done with modifications and combinations of currently available clamps, but not as readily as with the new door support clamp.

Further, another utilization of sawhorses assembled with these brackets follows. A board, for instance a 2×6, of such a length that is longer than the distance between the two spreader braces 24 at either end of one sawhorse, but less long than the distance from the outside of one pair of legs to the outside of the opposite pair of legs, can be laid across the two spreader braces 24. This done on both sawhorses of a pair establishes a lower level of storage for boards, trim, etc., a space utilization and convenience advantage.

SUMMARY, RAMIFICATIONS, AND SCOPE

From the above it can be seen that the sawhorse brackets described can offer, primarily to commercial users, but also to serious home craftsmen and hobbyists, many combined advantages not presently available in complete sawhorses or sawhorse brackets. They are flexibility of size of finished sawhorse; foldability; very easy set up and fold up; very substantial bracing for support of heavy loads; a lower storage level; and ability to be used as a vertical clamping surface for work on door and board edges.

While the above descriptions contain many specificities, these should not be construed as limitations on the scope of this invention, but rather as an exemplification of one preferred embodiment thereof. Many other variations are possible. For example, differences in the dimensions of most every part of the sawhorse bracket are possible; differences in methods of pivoting or hinging; differences in the construction of the spreader brace; and differences in the way wood top and leg members are attached. Also, regarding materials used for construction of the bracket, the sheet steel mentioned can be left untreated, or can be painted or plated; also, galvanized steel, stainless steel, aluminum, or other metals, from sheets, angles, extrusions, or castings could be used; or, perhaps, even some superior plastics, graphites, fiberglasses, cycolacs, etc. could be used. Accordingly, the scope of the invention should be determined not by the embodiments illustrated, but by the appended claims and their legal equivalents.

I claim:

1. A folding bracket which, when used in pairs, provides attachment surfaces, for an extended duration, of an elongated top beam and four elongated leg members of variable length, variable width and variable thickness, for the purpose of constructing a complete sawhorse or the like, the two sides of said completed sawhorse being readily foldable flatly against one another, and wherein said folding bracket comprises two pivotally connected bracket sides, each said bracket side comprising:

(a) an elongated top beam attachment plate, (b) an elongated leg attachment angle plate having an attachment to said top plate at a 90° angle, (c) an elongated bracing means diagonally connected to said top plate and said leg plate near the ends of each said plate opposite their said 90° attachment, thereby substantially bracing said top and said leg plates, (d) two pivot tabs, an upper leg pivot tab located at upper end of said elongated leg attachment plate and an inner pivot tab located at end of said top beam attachment plate opposite said top plate's attachment to said leg plate, at which said pivot tabs both said bracket sides are pivotally connected, and with both said bracket sides being connected by (e) a pivotally foldable bracing means connected pivotally to the lower area of each said leg plate of each said side of said bracket.

2. The folding bracket of claim 1 wherein attachment of said elongated top beam is such that the end of said elongated top beam may be even with or overlapping of the outside edges of said elongated leg members.

3. The folding bracket of claim 1 wherein said leg plate is L-shaped in cross-section.

4. The folding bracket of claim 3 wherein the attachment of said elongated leg members may be such that the material of said leg members can extend beyond the outer edges of said leg plate, resulting in an outer end surface of said leg members being unobstructed by material of said leg plates.

5. The folding bracket of claim 1 wherein a vertical inclination of each pair of said leg members results when said completed sawhorse is in an open position.

6. A folding bracket which, when used in pairs, provides attachment surfaces, for an extended duration, of an elongated top beam and four elongated leg members of variable length, variable width and variable thickness, for the purpose of constructing a complete sawhorse or the like, the two sides of said completed sawhorse being readily foldable flatly against one another, and wherein said folding bracket comprises two pivotally connected bracket sides, each said bracket side comprising:

(a) an elongated top beam attachment plate wherein attachment of said elongated top beam is such that the end of said elongated top beam may be even with or overlapping of the outside edges of said elongated leg members and wherein the end of said elongated top beam is even with the outside edges of said elongated leg members, (b) an elongated leg attachment angle plate having an attachment to said top plate at a 90 degree angle wherein said leg plate is L-shaped in cross section, wherein the attachment of said elongated leg members may be such that the material of said leg members can extend beyond the outer edges of said leg plate, wherein said outer end surface of said leg members are unobstructed by material of said leg plates, and wherein a vertical inclination of each pair of said leg members results when said completed sawhorse is in an open position, such that said combination of above three conditions results in a vertical, unobstructed surface, usable as a surface against which elongated work pieces may be supported and clamped by a plurality of independent clamping means attached to a plurality of said leg members of either one or a plurality of said complete sawhorses, (c) an elongated bracing means diagonally connected to said top plate and said leg plate near the ends of each said plate opposite their said 90 degree attachment, thereby substantially bracing said top and said leg plates, (d) two pivot tabs, an upper leg pivot tab located at upper end of said elongated leg attachment plate and an inner pivot tab located at end of said top beam attachment plate opposite said top plate's attachment to said leg plate, at which said pivot tabs both said bracket sides are pivotally connected, and with both said bracket sides connected by (e) a pivotally foldable bracing means connected pivotally to the lower area of each said leg plate of each said side of said bracket.

7. The folding bracket of claim 1 wherein said bracing means is connected at said lower area of each said leg plate of each said side of said bracket, and wherein said bracing means lies in an elongated horizontal inclination when said completed sawhorse is in an open position, offering a support point for one end of an independent elongated support means, the other end of said elongated support means being supportable at said bracing means of second said bracket of said completed sawhorse.

8. The folding bracket of claim 7, when paired with a like said support means of a second said complete sawhorse, providing a level of support for elongated work pieces below the level of said top beams of said complete sawhorse.

9. A folding bracket which, when used in pairs, provides attachment surfaces, for an extended duration, of a top beam and four leg members of variable length, variable width and variable thickness, for the purpose of constructing a complete sawhorse or the like, the two sides of said completed sawhorse being readily foldable flatly against one another, and wherein said folding bracket comprises two pivotally connected bracket sides, each said bracket side comprising:

(a) a top beam attachment plate;

(b) a leg attachment plate for being attached to said top beam attachment plate;

(c) bracing means connected to said top beam attachment plate and said leg attachment plate for bracing said top beam attachment plate and said leg attachment plate;

and with both said bracket sides being connected by (d) pivot means for pivotally connecting said bracket sides to one another.

10. The folding bracket of claim 9 wherein said pivot means includes a first pivot tab attached to one of said bracket sides at the upper end of said leg attachment plate thereof, a second pivot tab attached to the other of said bracket sides at the upper end of said leg attachment plate thereof, and a pivot for pivotally joining said first and second pivot tabs to one another.

11. The folding bracket of claim 10 wherein said pivot means includes a third pivot tab attached to said top beam attachment plate of one of said bracket sides at a point spaced from the attachment of said top beam attachment plate to said leg attachment plate thereof, a fourth pivot tab attached to said top beam attachment plate of the other of said bracket sides at a point spaced from the attachment of said top beam attachment plate to said leg attachment plate thereof, and a pivot for pivotally joining said third and fourth pivot tabs to one another.

12. The folding bracket of claim 9 wherein said pivot means includes a pivotally foldable bracing means connected pivotally to the lower area of each said leg attachment plate of each said bracket side.

* * * * *